United States Patent [19]

Rice et al.

[11] Patent Number: 4,557,095

[45] Date of Patent: Dec. 10, 1985

[54] VENT ASSEMBLY FOR ELECTRICAL ENCLOSURE

[75] Inventors: Paul D. Rice; Jeffrey O. Sharp, both of Lexington, Ky.

[73] Assignee: Square D Company, Palatine, Ill.

[21] Appl. No.: 509,278

[22] Filed: Jun. 29, 1983

[51] Int. Cl.[4] ..... E06B 7/08

[52] U.S. Cl. ..... 52/473; 98/121.1

[58] Field of Search ..... 52/473; 98/121 R; 361/383, 384; 312/236; 174/66, 67

[56] References Cited

U.S. PATENT DOCUMENTS 2,803,185 8/1957 Coleman ..... 98/121 R 3,267,834 8/1966 Hockett ..... 98/121 R

*Primary Examiner*—Carl D. Friedman

*Attorney, Agent, or Firm*—Larry I. Golden; Richard T. Guttman

[57] ABSTRACT

A vent assembly for electrical equipment comprising a panel for covering the equipment in which the panel has at least one elongated slot extending therethrough, a front side, and a rear side. A box member is secured to the rear side of the panel over the slot with the box member having a first elongated plate extending outwardly from the rear side of the panel on one side of the slot and an elongated second plate extending from an outer end of the first plate over the slot at an angle to the first plate. The second plate has an outer edge. An elongated flange extends from the rear side of the panel on the other side of the slot at an angle to the panel which is generally directed toward the box member. The flange has an outer edge and is of sufficient width to intersect a straight line taken from the side of the slot nearest the box member to the outer edge of the second plate.

13 Claims, 5 Drawing Figures

VENT ASSEMBLY FOR ELECTRICAL ENCLOSURE

BACKGROUND OF THE INVENTION

The present invention relates to vent assemblies for electrical equipment.

It is known that various electrical equipment, such as wiring or switches, may generate heat during use, and it is desirable to dissipate this heat. This may be accomplished by providing vents for the electrical equipment to permit passage of air to and from the electrical equipment. However, for safety reasons such vents should be constructed to prevent direct access to the electrical equipment. In fact, this is a requirement for approval by Underwriters' Laboratories. Further, the vent assembly should be of simplified construction to minimize the expense of manufacture and ease assembly.

SUMMARY OF THE INVENTION

The principal object of the present invention is thus to provide a vent assembly for electrical equipment enclosures of simplified construction and improved air flow but which prevents direct access therethrough.

In a preferred embodiment of the vent assembly, a panel is provided for covering the equipment which has at least one elongated slot extending therethrough, a front side, and a rear side. An open box member is secured to the rear side of the panel over the slot. The box member has a first elongated plate extending outwardly from the rear side of the panel on one side of the slot and an elongated second plate extending from an outer end of the first plate over the slot at an angle to the first plate. Further, an elongated flange extends from the rear side of the panel on the other side of the slot at an angle to the panel which is generally directed toward the box member. Both the second plate and the flange have an outer edge.

A feature of the invention is that the flange has a width sufficiently long to intersect a straight line taken from the side of the slot nearest the box member and the outer edge of the second plate.

DESCRIPTION OF THE DRAWINGS

The foregoing objects and features of the invention will be described in greater detail and further features will be made apparent from the appended claims and in the following detailed description which is given with reference to the several views of the drawing, in which:

DETAILED DESCRIPTION

Figure 1:
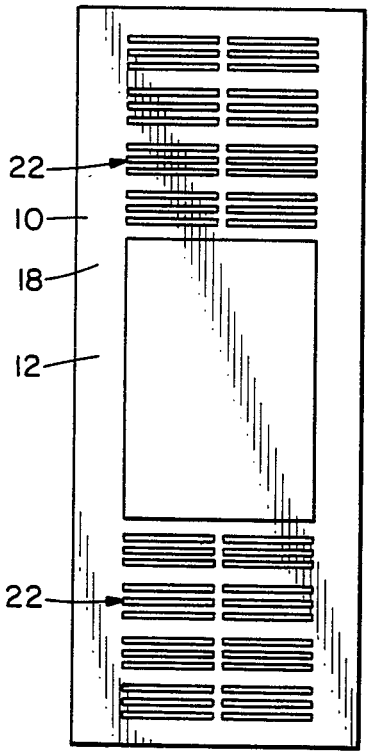
FIG. 1 is a front plan view of a panel having a vent assembly of the present invention.
Figure 2:
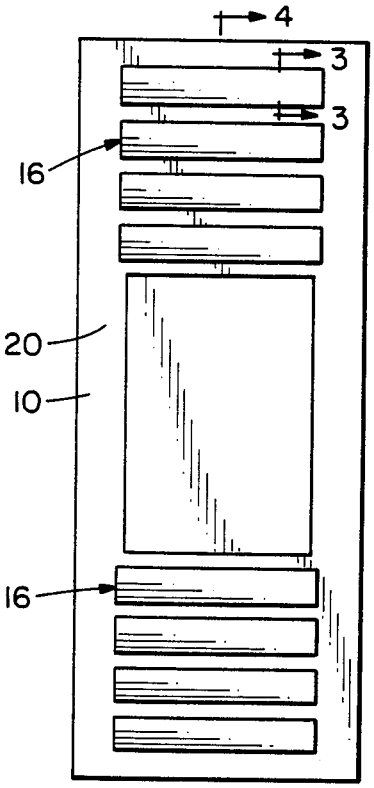
FIG. 2 is a back plan view of the panel and vent assembly of FIG. 1.
Figure 4:
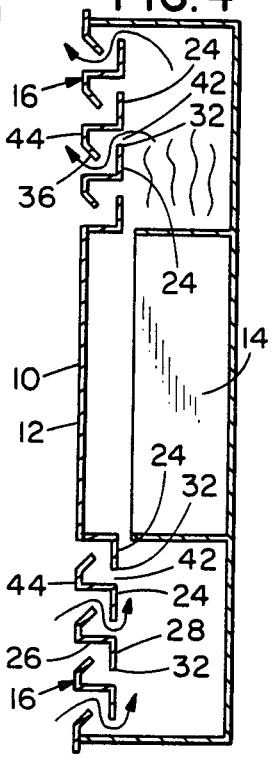
FIG. 4 is a sectional view illustrating one embodiment of a plurality of vent assemblies in accordance with the present invention.

Referring now to FIGS. 1, 2 and 4, in a preferred embodiment of the invention there is shown a panel 10 having a vertical central portion 12 for covering electrical equipment 14. The panel 10 has a plurality of vent assemblies 16 located below the central portion 12 in order to permit passage of cool air to the equipment 14 and a plurality of vent assemblies 16 located above the central portion 12 in order to permit passage of hot air from the equipment 14 to the outside of the panel 10. Preferably the panel 10 and vent assemblies 16 are constructed from metal.

Figure 3:
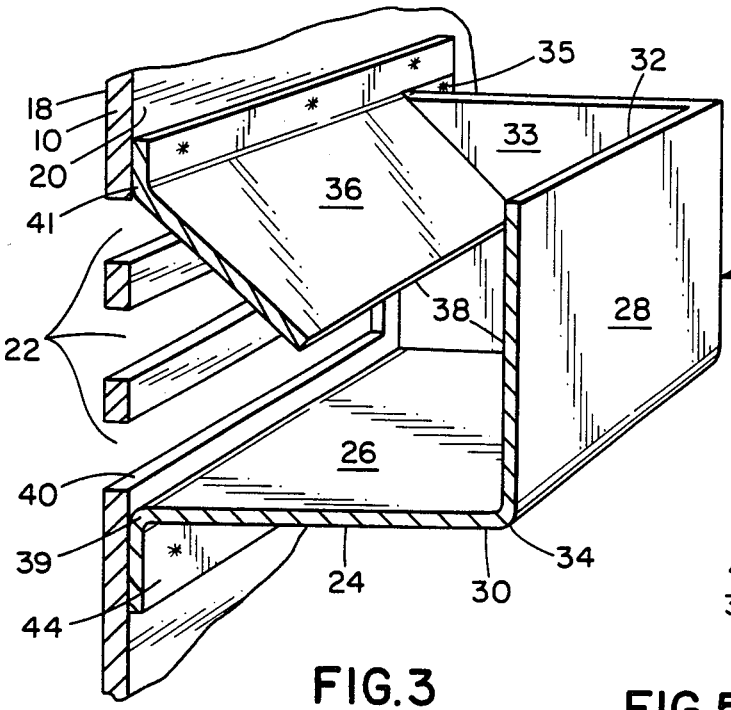
FIG. 3 is a fragmentary sectional view on an enlarged scale of the vent assembly.

With reference to FIG. 3, the panel 10 has a front side 18 and a rear side 20. The panel 10 also has a plurality of elongate slots 22, such as two columns of groups of three slots, associated with each of the vent assemblies 16.

The vent assembly 16 has a box member 24 secured to the rear side 20 of the panel 10 over the associated slots 22. The box member 24 has a first elongated plate 26 extending outwardly from the rear side 20 of the panel 10 on one side of the associated slots 22. In a preferred form, the first plate 26 is disposed generally perpendicular to the panel 10. The box member 24 has an elongated second plate 28 extending from an outer end 30 of the first plate 26 over the associated slots 22, with the second plate 28 having an outer edge 32. Preferably the first and second plates 26 and 28 are integrally formed from a single piece and are connected by a bend 34. As seen, the second plate 28 is disposed generally parallel to the panel 10.

The vent assembly 16 has an elongated flange 36 extending from the rear side 20 of the panel 10 on the other side of the associated slots 22 at an angle to the panel 10 which is generally directed toward bend 34 of box member 24. Preferably the flange is disposed approximately 45° to the panel 10. Also, the flange 36 has an outer edge 38. As shown, the flange 36 has a width sufficiently long such that the flange 36 intersects a straight line taken from the side 40 of the slot 22 nearest the first plate 26 and the outer edge 32 of the second plate 28. In this manner, the vent assembly 16 prevents direct access through the vent assembly 16 to the electrical equipment for purposes of safety.

Figure 5:
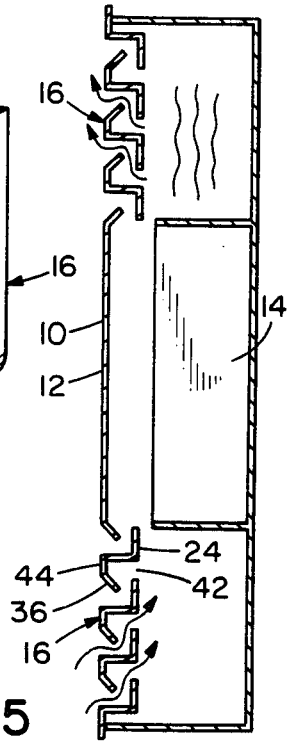
FIG. 5 is a sectional view illustrating another embodiment of a plurality of vent assemblies in accordance with the present invention.

As best seen in FIG. 4, the vent assemblies 16 are arranged in a contiguous relationship both below and above the central portion 12 of the panel 10. The outer edges 32 of the box members 24 are spaced from adjacent box members 24 to define openings 42 therebetween. In a preferred form, adjacent box members 24 and flanges 36 are of one-piece construction, with the box members 24 and flanges 36 being connected by an elongated attachment plate 44 which is secured to the panel 10. In the preferred embodiment of FIG. 4, the second plates 28 of the upper box members 24 are directed upwardly, and the second plates 28 of the lower box members are directed downwardly. In the embodiment of FIG. 5, the second plates 28 of the upper box members 24 are directed downwardly, and the second plates 2 of the lower box members 24 are directed upwardly.

It has been found that for the purpose of ventilating a 600 ampere rated load center, the depth of the box 24 inward from panel 10 should be no more than 1.5 inches within a $5\frac{3}{4}$ inch deep enclosure to prevent interference with the wiring space. It has also been learned that sufficient ventilation can be provided through the use of a four level matrix scheme of slots both above and below the central portion 12 of panel 10 as shown in FIG. 1 of the Drawings. Four rows of side-by-side triple slots are provided at both the top and bottom of the panel, with one box member 24 associated with each row of triple slots.

In the preferred embodiment as shown in FIG. 4, both above and below the central portion 12, the vent assembly is constructed by positioning a box member 24 over the slots adjacent the central portion 12 with plate 28 positioned with edge 32 directed away from the central portion of the panel and then aligning three box-angle members which comprise a box portion and connected flange portion 36 and finally aligning a flange or angle member adjacent the top and bottom rows of the triple slots.

Ready assembly of the venting arrangement for each panel is facilitated by use of six box-angle members plus two box members and two angle members which self align by receipt of the flange portion 36 of one member within box portion 24 of an adjacent member. Each of the members comprising the vent assembly are spot welded to the panel 10. The box-angle members are formed from appropriately dimensioned punched sheet metal. A bend 39 is formed in the metal to define the connection between the attachment plate 44 and the first plate 26. A reverse bend 34 is formed at the opposite end of the first plate serving as connection to the second plate 28. Opposite side tabs 33 are turned to form a box structure with the first and second plates. The tabs are bent to form right angles with both the first plate and the second plate. A distal portion of each tab 33 is reverse bent to provide a weld strip 35 which is in generally parallel relationship with the second plate 28 and can be welded or otherwise fastened to the panel. A final bend 41 serves as the connecting point between plate 44 and flange 36. Flange 36 is dimensioned to be received between tabs 33 of an adjacent box portion which facilitates alignment of the members comprising this vent assembly. The box members and angle members are formed from sheet metal which has been dimensioned to form those particular separate components of the vent assembly. In the preferred embodiment, the height of each slot 22 measures is approximately one third the distance from the outer edge 38 of flange 36 to the first plate as well as one third the distance from the outer edge of the flange to the second plate. With three panel slots associated with each box member, the cumulative slot height dimension is approximately equal to the distance the outer edge of the flange 36 is spaced from both the first plate and the second plate.

Thus the object of this invention is achieved, in that the vent assembly 16 prevents direct access to the electrical equipment, yet facilitates the free passage of air, and in the preferred embodiment of FIG. 4, the requirements for approval by Underwriters's Laboratories are satisfied. In addition, the vent assembly 16 provides simplified and accurate construction with minimal cost for manufacture.

The foregoing detailed description is given for clearness of understanding only, and no unnecessary limitations should be understood therefrom, as modifications will be obvious to those skilled in the art.

We claim:

1. A vent assembly for electrical equipment, comprising:

a panel for covering the equipment, said panel having at least one elongated slot extending therethrough, a front side, and a rear side;

a box member secured to the rear side of the panel over the slot, said box member having a first elongated plate extending outwardly from the rear side of the panel on one side of the slot and an elongated second plate extending from an outer end of the first plate over the slot at an angle to the first plate, said second plate having an outer edge; said box member further including a pair of opposite side tabs positioned substantially at right angles with said first plate and said second plate, and an elongated flange extending from the rear side of the panel on an other side of the slot at an angle to the panel and being generally directed toward said outer end of said first plate, said flange having a length substantially spanning the distance between said side tabs and having an outer edge and a width sufficiently long such that the flange intersects a straight line taken from the side of the slot nearest the box member and the outer edge of the second plate, said outer edge of said flange spaced away from said first plate and from said second plate enabling the passage of air through said assembly.

2. The assembly of claim 1 wherein the first plate is disposed generally perpendicular to the panel.

3. The assembly of claim 1 wherein the second plate is disposed generally parallel to the panel.

4. The assembly of claim 1 wherein the flange is disposed approximately 45° to the panel.

5. The assembly of claim 1 wherein the first and second plates are of one-piece construction.

6. The assembly of claim 6 wherein the first and second plates are connected by a bend.

7. The assembly of claim 1 wherein the second plate is directed upwardly.

8. The assembly of claim 1 wherein the panel includes a plurality of generally parallel elongated slots and the assembly includes a plurality of box members of similar construction over different slots, and a plurality of angled flanges of similar construction associated with different box members, said different box members and flanges being arranged in a contiguous relationship with the outer edges of the box members being spaced from adjacent box members to define an opening therebetween.

9. The assembly of claim 8 wherein each box member is positioned over a plurality of associated slots, said slots each having a predetermined height, said outer edge of said flange spaced from said first plate by a distance substantially equal to the cumulative heights of the associated slots.

10. The assembly of claim 9 wherein said outer edge of said flange is spaced from said second plate by a distance substantially equal to the cumulative heights of the associated slots.

11. The assembly of claim 1 wherein adjacent box members and flanges are integrally formed from a single piece.

12. The assembly of claim 1 wherein the panel includes a vertical central portion being free of slots, and in which a plurality of slots, box members, and flanges are located above and below the panel central portion.

13. A vent assembly as claimed in claim 1, wherein each said side tab includes a weld strip extending at substantially a right angle in generally parallel relation with said panel, and fastening means for securing each said weld strip to said panel.

* * * * *